United States Patent [19]

Roe et al.

[11] 4,058,333

[45] Nov. 15, 1977

[54] DOOR LATCH FOR RECREATIONAL VEHICLE AND OTHER APPLICATIONS

[75] Inventors: Forrest D. Roe, La Mirada; Sidney Simon, Encino, both of Calif.

[73] Assignee: Perma Bilt Industries, Torrance, Calif.

[21] Appl. No.: 708,220

[22] Filed: July 23, 1976

[51] Int. Cl.[2] ..... E05C 1/12

[52] U.S. Cl. ..... 292/172; 70/461; 292/142; 292/DIG. 60

[58] Field of Search ..... 292/160, 172, 142, 347, 292/39, DIG. 60, 147; 70/461, 85

[56] References Cited

U.S. PATENT DOCUMENTS

| | | | |
|---|---|---|---|
| 321,380 | 6/1885 | Murphy | 292/172 |
| 1,093,637 | 4/1914 | Lint | 292/172 |
| 1,215,286 | 2/1917 | Kollmeyer | 292/172 |
| 1,403,144 | 1/1922 | Brown | 292/142 X |
| 1,427,991 | 9/1922 | Whittaker | 292/172 |
| 1,511,956 | 10/1924 | Flagg | 292/172 |
| 2,253,257 | 8/1941 | Wellman | 292/172 |
| 2,290,728 | 7/1942 | Best | 292/172 |
| 2,967,728 | 1/1961 | Falk | 292/347 |
| 3,339,958 | 9/1967 | Lint | 292/347 X |
| 3,806,171 | 4/1974 | Fernandez | 292/39 |

FOREIGN PATENT DOCUMENTS

| | | | |
|---|---|---|---|
| 661,855 | 7/1929 | France | 292/172 |
| 2,026,582 | 12/1971 | Germany | 70/461 |
| 2,012,546 | 9/1971 | Germany | 70/461 |

*Primary Examiner*—Roy D. Frazier
*Assistant Examiner*—Rodney H. Bonck
*Attorney, Agent, or Firm*—Richard H. Zaitlen

[57] ABSTRACT

An improved door and drawer lock or latch having special utility in recreational vehicles, boats, emergency vehicles and the like is disclosed. The door lock comprises a latch housing having at least one toothed rack gear assembly, a pinion gear member and an elongated shaft. The elongated shaft is rotatably disposed in the pinion gear and extends outwardly therefrom. A retractable bolt member is also disposed in the latch housing and has an extended and a retracted position. In the extended position, the bolt engages a strike plate mounted on the frame or stile of the cabinet. The bolt member is coupled to the rack such that movement of the rack in a predetermined direction causes the bolt to move into the retracted position. A door knob is also coupled to the latch housing by an elongated hollow stem which extends circumferentially about the shaft member. The shaft member is secured therein such that movement of the knob causes the pinion gear member to rotate and thereby move the bolt into the retracted position. By the use of the door lock of the present invention, the lock may be coupled to the door in a plurality of positions vis-a-vis the edge of the door.

8 Claims, 7 Drawing Figures

DOOR LATCH FOR RECREATIONAL VEHICLE AND OTHER APPLICATIONS cl BACKGROUND OF THE INVENTION

1. Field of the Invention

This invention relates to a door and drawer latch apparatus, and, more specifically, to an improved door and drawer latch apparatus having special utility for cabinets and the like.

2. Prior Art

Cabinet door locks are well known in the prior art and the need for such locks is obvious. One such typical cabinet door lock comprises the use of magnet and a metal plate. the magnet is mounted on the inside of the cabinet and a metal plate is disposed on the back side of the cabinet door. When the cabinet door is closed, the magnet makes contact with the metal plate thereby retaining the door in the closed position. When the user desires to open the door, it is merely pulled open thereby disengaging the magnet from the metal plate. While this type of door lock mechanism is simple and straight forward, banging and jarring of the cabinet may cause premature opening thereof. While in a typical home there is no criticality associated with undesirable opening of cabinets and the like, in a recreational vehicle or other type situation, the cabinets therein are subjected to much greater movement than a cabinet in a home. Accordingly, there is a corresponding greater need for more security with respect to how the cabinet is closed. This can be of critical importance when one considers that dishes, cans, and the like are usually kept in such cabinets and going over a bump in the road may cause the cabinet to open, spilling the contents out into the recreational vehicle. This represents a substantial hazard to the vehicle itself as well as to the driver of the vehicle. In response to this problem, prior art has developed positive locking systems whereby a latch is coupled to the cabinet door and a strike is coupled to the door frame. In operation of this prior art device, when the bolt or such a locking device is in the extended position, it engages the strike thereby preventing premature opening of the cabinet door. Unfortunately, there are many shortcomings associated with such prior art devices. On such shortcoming is the fact that accurate alignment between the bolt and the door strike is essential in order to close the cabinet door. This is because the bolt (or latch) must be located in one single position with reference to the edge of the door in order to engage the strike on cabinet frame. This, in turn, requires that the latch housing containing the bolt member be accurately positioned with respect to the door strike. Unfortunately, in such prior art devices, the knob which activates the bolt, must be located in specific angle position on the other side of the door. Thus, should the door be scalloped or have other decorations, adjacent one end thereof, such decorations could interfere with the proper positioning of the door knob. Accordingly, many prior art latching systems required either could not be used in scalloped or otherwise decorated doors, or required the removal of such decorations. Another shortcoming of the prior art door lock assemblies is the fact that some assemblies were constructed such that the thickness of the door was critical with respect to the various elements of the door lock assembly. More specifically, a shaft extended from the door knob through the door to the latch mechanism. Depending on the thickness of the door, the shaft would have to be changed such that accurate coupling of the shaft to the latching mechanism was achieved. If the shaft is too long, the latch housing could not be securely coupled to the back side of the door. On the other hand, if the latch is too short, the door knob buttom could be rotated or pushed or otherwise actuated without causing the latch housing to move the bolt into its retracted position. This necessitated shafts of varying lengths to be made in order to insure proper contact between the knob and the latch housing. Variations in door material thickness are common in the industry. Since many lock housing are installed "do it yourself,38 the installer must know the exact thickness of the door. Should even a minor error be made, such as, for example, plus or minus one sixteenth of an inch, the door lock assembly could not be installed.

Yet another shortcoming of the prior art cabinet door locks is the fact that a typical cabinet construction, doors are mounted in the cabinets in the "overlay" position or the "inset" position. In the overlay position, the edge of the door which is opened, overlays the edge of the frame. In such a configuration, the strike is positioned along the edge of the frame such that the latch is disposed within the circumference of the strike. For an inset door, part of the door extends into the frame area. That is, the door can have a lipped section which extends into the interior of the cabinet. For such an inset door, a differently configured strike is disposed on the door frame. Thus, the prior art required two different types of door strikes; one for overlay doors and a different one for inset doors. This requires furnishing two different kinds of strikes and also increases chances of the incorrect strike being furnished and installed. Of course, as is readily apparent, the manufacturing of two different types of strikes is expensive in that it requires two different types of punch press dies or other constructions means.

The present invention provides a solution to the above-identified shortcomings of the prior art and provides a locking system which can be easily disposed through doors of varying thicknesses and which can be positioned in a plurality of positions with respect to the edge of the door thereby permitting doors with elaborately designed edges to have a lock assembly of the present invention coupled thereto without destruction of the design. Moreover, the present invention provides a single strike which can be used both for overlay doors and for inset doors.

SUMMARY OF THE INVENTION

The present invention relates to door lock assemblies and more specifically, to door lock assemblies having special utility in recreational vehicle cabinets and the like. In the first embodiment of the present invention, the door lock assembly comprises a latch housing having an elongated tooth rack assembly and a pinion gear member disposed therein. The teeth of the gear member are interdigitated with the teeth of the rack assembly. Axially disposed in the gear is an outwardly extending elongated shaft. The shaft and the pinion gear are disposed on the tooth rack assembly such that rotation of the shaft causes the gear member to rotate. Inasmuch as the teeth of the gear are coupled to the teeth of the rack, movement of the pinion gear causes the rack assembly to move, a retractable bolt member which may be an extension of the rack assembly or may be a separate element is disposed in the latch housing and is coupled to the rack such that movement of the rack in a predetermined direction causes the bolt to move into a retracted position away from the strike and into the latch housing. The latch housing is disposed on one side of the door with the shaft extending through the door and coupled to an associated door knob. The door knob has an elongated hollow stem through which the shaft circumferencially passes and is secured therein. Movement of the door knob causes the shaft to rotate thereby rotating the gear member and thus moving the bolt into the retracted position. In this retracted position, the latch no longer engages the strike disposed on the frame of the cabinet permitting the door to open.

In the second embodiment of the present invention, the latch housing has first and second tooth rack assemblies and first and second gear members. The toothed rack assemblies are slidably disposed in the housing in a substantially parallel and spaced apart configurations with the gear members disposed thereinbetween. The first gear member is a working pinion gear, that is, the first gear member has the elongated shaft rotatably coupled thereto. The second gear member is a stabilizing pinion gear and is used to maintain the proper positioning between the first and second rack during activation of the bolt member. The bolt member is disposed in the housing between the first and second rack assemblies such that movement of either of the rack assemblies causes the bolt to move into its retracted position. In the second embodiment of the present invention, retraction of the bolt can be achieved by movement of either the first or the second rack assembly. This enables the door knob to be rotated either clockwise or counter-clockwise. In the first embodiment of the present invention, activation of the door knob is limited to either a clockwise or counter-clockwise movement.

It is therefore one object of the present invention to provide a door lock assembly which can be mounted in a plurality of positions with respect to the edge of a typical cabinet door.

Another object of the present invention is to provide a door lock assembly which can be mounted on doors of varying thicknesses without the need for using shafts of varying lengths.

Yet a further object of the present invention is to provide a door lock which can be made inexpensively and is of relatively simple construction, enabling the door lock to be mounted in a "do it yourself" manner.

The novel features which are believed to be characteristic of the invention, both as to its organization and method of operation, together with the further objectives and advantages thereof, would be better understood from the following description considered in connection with the accompanying drawing in which a presently preferred embodiment of the invention is illustrated by way of example. It is to be expressly understood, however, that the drawing is for the purpose of illustration and description only and is not intended as a definition of the limits of the invention.

BRIEF DESCRIPTION OF THE DRAWINGS

Referring first to FIG. 1, the novel door lock assembly of the present invention is clearly shown. The door lock assembly 10 is positioned in a typical door 12 adjacent one side thereof, such that it is in close proximity to the door frame 14. As discussed above, the door lock 10 of the present invention has particular utility in recreational vehicles because it provides the door 12 with a positive latching system.

Figure 1:
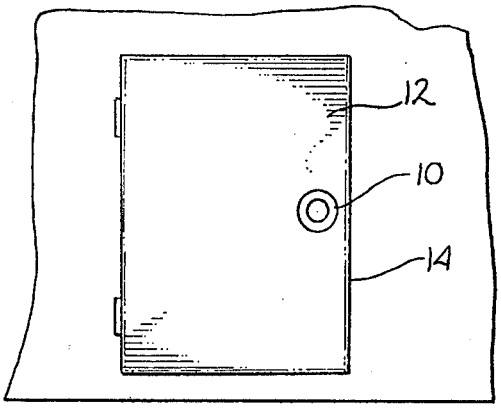

Toothed members 46 engage a typical working pinion gear 44 such that the teeth of the gear 44 are interdigitated with the teeth 46 of the rack 24. Pinion gear 44 is held in position by bar or back cover member 26. Bar 26 is slidably coupled to the top and bottom of the latch housing 17 such that the entire door lock assembly 10 may be mounted in the plurality of different positions as hereinafter discussed.

Figure 3:
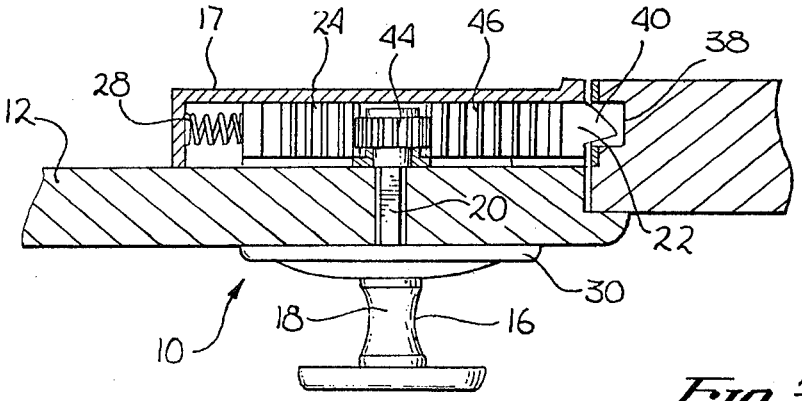
Figure 5:
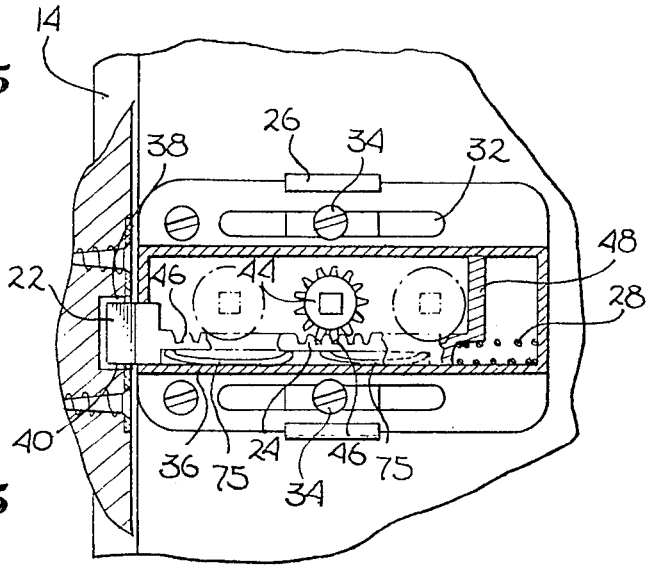

Referring not to FIGS. 3 and 5, one can see that the elongated toothed rack assembly 24 is disposed in the latch housing 17 such that the bolt 22 extends outwardly therefrom and into a uniquely designed door strike 38. Door strike 38 as shown in FIG. 5, provides an open area 40 into which the bolt 22 extends. This type of configuration is referred to in the art as an overlay door discussed hereinabove. A spring 28 is also positioned in the latch housing 17 between one end of the latch housing 17 and arm member 48 such that, in the normal position, the bolt member 22 is caused to extend into area 40. This is referred to herein as bolt 22 being in the "extended" position.

One problem which has plagued the prior art and which the present invention overcomes, is the need for providing a door lock system which can be mounted in a plurality of positions with respect to the edge of the door frame 14. For example, assume that the door 12 adjacent the sides thereof contains an area which is not adaptable for mounting a door lock. For example, assume that the edge of door 12 is scalloped or otherwise designed. This would require that the door lock assembly 10 be moved more toward the center of the door 12. The present door lock 10 enables this to take place inasmuch as the knob 16 need not be mounted in one specific position. This is achieved because of the combination of bar member 26, rack assembly 24 and working pinion gear member 44. More specifically, so long as gear 44 contacts the teeth 46 of rack 24, rotation of gear 44 will cause movement of the rack 24 and thus bolt 22. Bar 26 enables proper alignment of shaft 20 and gear 44, and also acts as a bearing for shaft 20.

Figure 4:
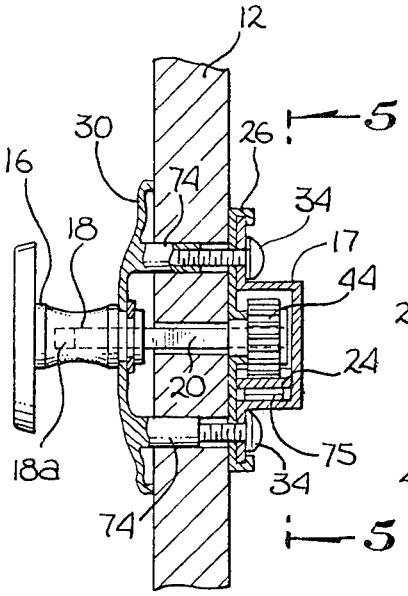

Referring again to FIGS. 3 and 4, one can see that shaft 20 extends into the door knob 16 into hollow area **18*a* of the stem 18. Area 18*a* is of a sufficient size such that the specific thickness of the door is not critical in that so long as the bolt 20 extends any amount into area 18*a*, positive locking of the door knob 16 and the shaft 20** thereof is achieved. This feature represents another part of novelty of the present invention and has the advantage of providing a lock assembly which does not require a specific length of shaft for a specific thickness of door.

Figure 2:
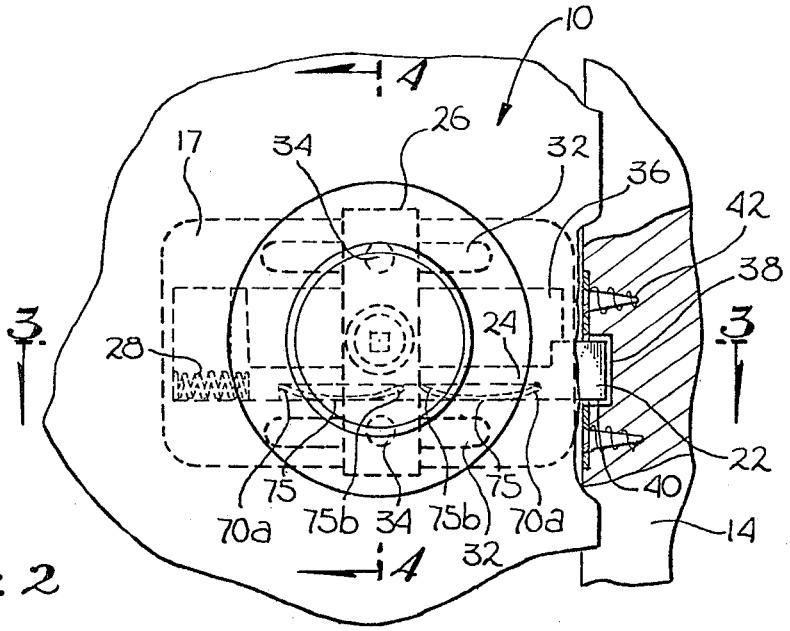
Referring now to FIGS. 2 and 3, one can see that the door lock assembly 10 is comprised of a generally rectangular latch housing 17, a retractable bolt member 22, and a typical door knob 16. In the preferred embodiment, the door lock 10 is arranged on the door 12 such that the rotatable door knob 16 is disposed on one side of the door 12 and the latch housing 17 is disposed on the opposite side thereof. Extending through the door 12 so as to couple the latch housing 17 with the door knob 16 is metal shaft 20. Shaft 20 extends into the hollow stem 18 of knob 16 in axial alignment and is secured therein such that rotation in a predetermined direction of knob 16 causes shaft 20 to rotate in the same direction. Within latch housing 17 as more fully shown in FIGS. 2 and 5, is an elongated rack assembly 24. Rack assembly 24, in the preferred embodiment, has a bolt member 22 disposed at one end thereof, which is a continuation of rack member 24, and an upwardly extending arm member 48 disposed at the other end thereof. Along the length of rack assembly 24, are a plurality of toothed members 46.

Yet another point of novelty is the arcuous-shaped, the flexible member 75 shown most clearly in FIGS. 2 and 5. Such flexible member 75, in the preferred embodiment, are formed as an integral member of the toothed rack assembly 24. The ends 75*a* are joined to the assembly 24, but ends 75*b* are free to flex. The flexible members are disposed on the assembly 24 adjacent the bottom thereof so as to be between the assembly 24 and latch housing. Of course, it is understood that other shapes for the flexible members 24 are within the scope of this invention. For example, the bottom of the rack assembly 24 could contain a slot along the length thereof with a shaped piece of metal having two downwardly ending sections disposed therein. Such flexible metal member would also act as a spring for the rack assembly 24 as hereinafter described.

The installation and operation of the door lock apparatus described with reference to FIGS. 1–5 is as follows:

First the area of mounting is determined. The area of mounting can be any area adjacent the door frame 14. But, because of the uniquely designed toothed rack 24 and movable pinion gear member 44, a plurality of lateral positions can be chosen with respect to the door frame 14. This permits the door lock assembly 10 to be mounted not only adjacent the door frame 14, but also some distance away from the door frame 14 thereby permitting scalloped edges and the like along the border of the door.

In the preferred embodiment, three holes are drilled through the door; one hole for the combination of stem 18 and shaft 20, and two holes for mounting members 74. Mounting members 74 extend outwardly from escutcheon 30 and are used to position the escutcheon 30 on the door 12. In the present embodiment, door knob 16 is axially disposed through escutcheon 30 with the stem 18 abutting the escutcheon 30. The shaft 20 is then inserted into the hollow stem area 18*a* in the stem 18 so as to pass through the hole in door 12. The bar member 26 is placed on the shaft 20 so as to be sandwiched between the door 12 and the latch housing 17. As pointed out hereinabove, bar 26 contains snap-type locking members which snap over the top and bottom of the latch housing 17. (See FIG. 5). Such snap-type lockings are well-known in the art and merely consist of flexible ends which yieldably engage the latch housing 17. Of course, it is understood, that other embodiments for slidably coupling the bar 26 to the housing 17 are within the scope of this invention.

Next, the latch housing 17 is inserted over the pinion gear member 44, such that the gear member 44 engages the tooth members 46 on the rack assembly 24. In the preferred embodiment, gear 44 is securely fastened to one end of shaft 20; the other end being engaged in the stem 18. Inasmuch as sufficient hollow stem are 18*a* is provided in stem 18, there is a certain degree of play in the shaft 20 which enables proper engagement of the pinion gear 44 with the tooth members 46. This enables the lock assembly 10 of the present invention to be mounted in doors of varying thicknesses without the need for selecting the stem to correspond to a specific door thickness. As discussed hereinabove, this enables "do it yourselfers" to mount the lock 10 on a plurality of doors of different thicknesses.

The latch housing 17 must be coupled to the back side of the door 12 such that the bolt 22, in its extended position, engages the door strike 38 and extends into the area 40. This means that the latch housing 17 must be mounted adjacent the door frame 14. However, because bar member 26 is slidably coupled to the housing 17, proper alignment is maintained as lateral movement of the latch housing 17 into the proper position merely causes bar member 26 to slide along the length of the housing 17. This lateral movement may also cause gear member 44 to rotate about its axis until the desired position is achieved. As indicated in FIG. 5 by hidden lines, pinion gear member 44 can move from one end of cavity 36 to the other. Once in its stable rest position, spring member 28 will cause the rack 24 and, accordingly, the bolt 22 to be pushed such that the bolt 22 extends into area 40. To secure the latch housing 17 to the door and to the bar 26, screw members 34 are inserted into slots 32 and tightened into the door 12. If a slightly different position is necessary for proper alignment, the screws can be loosened and slid in slot 32 until the proper alignment is achieved.

Now that the door lock 10 has been installed, rotation of the door knob 16, either clockwise or counter-clockwise, causes the stem 20 to rotate. This, in turn, causes pinion gear 44 to rotate thereby engaging tooth members 46. As the tooth members 46 are engaged by the pinion gear 44, they are caused to move away from the door frame 14 and compress spring 28. Inasmuch as rack 44 is coupled to bolt 22, movement of the rack 44 causes bolt 22 to retract inside of the latch housing 17. When the bolt 22 has retracted out of area 40, the door 12 is now free to open. The bolt 22 is now said to be in its "retracted" position. Because the spring 28 applies force to an area adjacent to arm 48, once knob 16 is released, the spring 28 will cause the bolt 22 to return to its normal, extended position. Closing the door is simple in that one need only push (or pull) the door 12 such that the bolt 22 engages the strike 38 thereby causing the bolt 22 to move into the latch housing 17 until the bolt clears the strike 38 whereupon it once again extends into area 40 thus, locking the door 12 to the door frame 14.

It should be noted, however, that in the first embodiment of the present invention, one must elect to configure gear 44 and rack 24 such that movement in one or the other direction moves bolt 22 into the retraction position, rotation of gear 44 in either direction will not cause the bolt 22 to retract. Assume the knob 16 shown in FIG. 3 is rotated clockwise. Such movement of the gear 44 and rack 24 as above described with cause bolt 22 to move into the retracted position. However, rotation of knob 16 in the opposite (counter-clockwise) direction does not move the bolt. To prevent breakage of any of the components of the latch, and especially the knob 16, and shaft 20, flexible members 75 are disposed on the rack 24 adjacent the bottom thereof. Rotation of gear 44 in the counterclockwise direction (FIG. 3) causes a downward force to be applied to the flexible spring-like member 75 (See FIG. 5). This downward force flattens such member 75 and causes the gear 44, to and more specifically, the teeth on gear 44, to disengage from the rack 24, i.e., a slipping action is created. This action prevents damages to the latch 10 in that should the knob 16 be rotated in a direction which does not cause the bolt 22 to move into the retracted position, the rotational force merely causes member 75 and more specifically 75*b*, to flex. Such rotational force is thus disrupted without breakage.

It is to be understood that other design features discuss with reference to the first embodiment of the present invention are also within the scope of this invention. For example, spring 28 can be substituted with other means which maintain an outward pressure on the rack 44 so as to cause the bolt to be selectively maintained in its extended position. Moreover, while in the preferred embodiment, the rack 44, latch housing 17, and bar member 26 are made of plastic, metal, and combination of metal and plastic is also within the scope of this invention. Other rotatable means can also be used to engage the rack 24 so as to move the bolt 22 into its retracted position. Finally, while bolt 22 is shown as being a continuation of rack assembly 24, bolt 22 can be a separate element coupled to rack 24.

Figure 6:
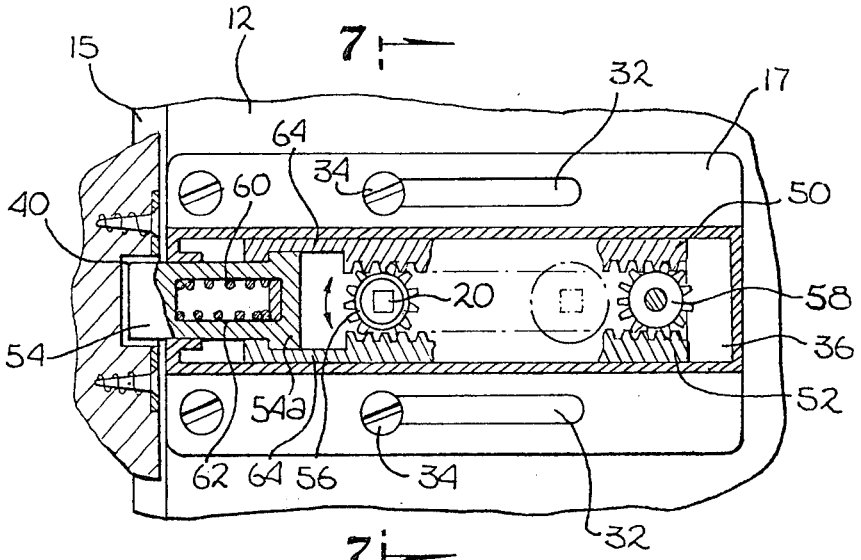

The second embodiment, shown with respect to FIGS. 6 and 7, overcomes one problem associated with the first embodiment discussed with reference to FIGS. 1–5. In the first embodiment of the present invention, door lock 10 required that the knob 16 be turned in one specific direction or to be equipped with flexible members 75 on the rack assembly 24 without such member 75, if the knob 16 was turned in an opposite direction from that desired, the result would be to apply a force to rack 24 so as to cause the bolt 22 to further extend into area 40. Such action clearly does not cause the door 12 to open and unnecessarily put force on the toothed rack 24 and the pinion gear 46. In the second embodiment, this problem is overcome by the use of first and second toothed rack members 50 and 52, and without teh need for flexible members 75. As indicated in FIG. 6, one cal see that the latch housing 17 of the second embodiment of the present invention has substantially the same configuration as that described with reference to the first embodiment. However, within the cavity 36, there are substantial differences. For example, there is an upper rack assembly 50 and a lower rack assembly 52 in a substantially parallel and spaced apart configuration. There are also first and second pinion gear members 56 and 58 positioned between the rack assemblies. Pinion gear member 56 is referred to herein as the working gear member 56 to engage and move the upper and lower rack assemblies 50 and 52. Gear member 58 is referred to herein as idler gear member 58 and is disposed between the upper and lower or otherwise referred to herein as the first and second rack assemblies 50 and 52 so as to maintain the proper distance between such rack assemblies.

In the second embodiment of the present invention, a spring member 60 is disposed adjacent the bolt member 54 such that bolt member 54, in its natural position, is caused to extend into cavity 40. Bolt member 54 has an outward extending end area **54*a* which in turn is engaged by arm members 64. Arm members 64, in the presently preferred embodiment, are extensions of the toothed rack assemblies 50 and 52. The other aspects of the second embodiment of the present invention are substantially the same as that described with reference to the first embodiment of the present invention such as, for example, the method of mounting, and the ability to place the knob 16 in a plurality of positions on the door. The repositioning of the working gear 56 is indicated in FIG. 6 by phantom lines which indicates the many positions which working gear 56 can have and still cause the door lock 10** to operate properly.

Figure 7:
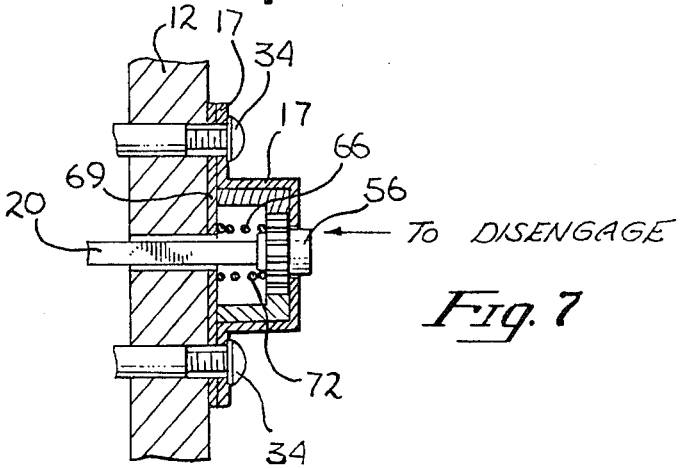

Referring now to FIG. 7, a further advantage of the second embodiment of the present invention is shown. Disposed between the back 69 of latch housing 17 and the working gear 56 is a second spring member 66. Spring member 66 is arranged and configured in area 72 such that the shaft 20 can be pulled outward with respect to the door 12 causing the spring 66 to be compressed. Inasmuch as working gear 56 is coupled to shaft 20, this outward movement of shaft 20 will cause the working gear 56 to disengage from the first and second rack assemblies 50 and 52. In this disengaged position, the door knob 16 can be moved either to the left or to the right in order to move the door knob into its desired location. Releasing the door knob 16 will enable the working gear 56 to once again engage the rack assemblies 50 and 52 because of the outward extending force applied by spring 66. This feature enables the mounting of the door lock of the second embodiment of the present invention with relative ease and without the need for complex aligning procedures. It should also be noted that in the second embodiment, no bar member is needed. Instead, the back 59 and the latch housing 17 are made of one discrete piece of material. After the back 69 is attached to the door 12, the latch housing 17 is flipped up and secured thereto by screw means 34.

In operation of the second embodiment of the present invention, rotation of knob 16 will cause shaft 20 to rotate. Rotation of shaft 20 in turn will cause working gear 56 to rotate. However, inasmuch as gear 56 is coupled to both the upper and lower toothed rack assemblies 50 and 52, respectively, one of the rack assemblies will be driven toward the door frame 14; then rack assembly 52 will be driven away from the door frame 52 or vice-versa. However, no matter what direction the gear member 56 is rotated, at least one rack assembly will engage the end **54*a* of the bolt 54 and cause it to move into its retracted position thereby opening the door. Releasing the door knob 16 will permit the spring 60 to exert sufficient force on the bolt 54 to once again drive the bolt into its normal extended position. Thus, in the second embodiment of the present invention, the knob 16 can be rotated either clockwise or counterclockwise and still cause the bolt 54 to move into the retracted position. Rotation of gear 54 and the associated movement of the rack assemblies 50 and 52 will also cause gear 58 to rotate. This rotation has no great bearing on the operation of the lock, but it has been found that the interdigitated aspect of gear 58** with both rack assemblies maintains the proper spacing and increases the useful life of the lock.

Although this invention has been disclosed and described with reference to a particular embodiment, the principles involved are susceptible of other applications which will be apparent to persons skilled in the art. This invention, therefore is not intended to be limited to the particular embodiment hereindisclosed. For example, while the first and second embodiments have been described and disclosed with respect to a lipped door (see FIG. 3), the latch also works equally well with respect to an overlay door. In the use of an overlay door, however, a different type of door strike has required by the prior art. In the present invention, however, the door strike which previously had been mounted on the door frame 14 need only to reversed to enable the bolt to engage an outwardly extending section of the door strike. Such reversible door strike represents another point of novelty of the present invention in that the need for manufacturing two different type door strikes for an inset or overlay door is eliminated.

I claim:

1. A door latch having special utility in recreational vehicles and the like comprising:

a latch housing, said latch housing having a toothed rack assembly, a gear member rotatably coupled thereto, and an elongated shaft member;

a retractable bolt member having an extended and a retracted position, said bolt member coupled to said rack such that movement of said rack in a predetermined direction causes said bolt member to move into said retracted position;

a slideable bar member disposed across said housing, said bar member selectively positioning said elongated shaft in said housing;

a door knob, said door knob having an elongated hollow stem, said shaft extending into said stem and being secured therein such that movement of said knob causing said gear member to rotate thereby moving said bolt into said retracted position; and wherein, a flexing means is disposed between said latch housing and said toothed rack assembly, said flexing means for yieldable coupling said gear member to said toothed rack assembly such that movement of said door knob in one direction causes said bolt to move into said retracted position without any flexing of said flexing means, said toothed rack assembly presses against said flexing means and is thereby selectively disengaged from said gear member.

2. The door latch of claim 1 wherein said bolt member is a continuation of said rack assembly.

3. The door latch of claim 1 wherein in addition thereto, a spring means is disposed in said latch housing such that said bolt remains in said extended position until said knob is activated.

4. The door latch of claim 1 wherein said door lock is disposed on a door, said door having a strike member arranged and configured to selectively engage said bolt, said strike being adapted for overlay and for inset doors.

5. The door latch of claim 1 where said flexing means is formed of two discrete arcuous member located adjacent the bottom length of said toothed rack assembly.

6. The door latch of claim 1 wherein said flexing means is formed integrally with said toothed rack assembly adjacent to the bottom thereof.

7. A door latch having special utility in recreational vehicles and the like comprising:

a latch housing, said latch housing having (i) first and second toothed rack assemblies; (ii) first and second gear members, said tooth rack assemblies being slidably disposed in said housing such that said gear members are disposed thereinbetween, and (iii) an elongated shaft disposed in said first gear assembly wherein said first gear is a working pinion gear and said second gear is a stablizing pinion gear, said first and second gears maintaining said first and second racks in a parallel and spaced apart configuration;

a retractable bolt member having an extended and a retracted position, said bolt member disposed in said housing between said first and second rack assemblies such that movement of either of said racking assemblies causes said bolt to move into said retracted positions;

a door knob, said door knob having an elongated hollow stem, said shaft extending into said stem and being secured therein such that movement of said knob causes said first gear member to rotate thereby moving said bolt into said retracted position; and wherein a spring means is circumferentially disposed about said shaft and adjacent said working pinion gear such that said working pinion gear is rendered selectively disengageable from said rack assembly thereby permitting lateral movement of said door knob.

8. The door latch of claim 7 wherein each said first and second racks having inwardly extending arms adjacent one end thereof, and said bolt member is disposed in said housing such that one of said arm members engages and moves said bolt when said first gear member is rotated.

* * * * *